US005118260A

United States Patent [19]

Fraser, Jr.

[11] Patent Number: 5,118,260

[45] Date of Patent: Jun. 2, 1992

[54] SCROLL COMPRESSOR PROTECTOR

[75] Inventor: Howard H. Fraser, Jr., Lafayette, N.Y.

[73] Assignee: Carrier Corporation, Syracuse, N.Y.

[21] Appl. No.: 700,289

[22] Filed: May 15, 1991

[51] Int. Cl.[5] ..... F04B 49/02

[52] U.S. Cl. ..... 417/18; 417/32

[58] Field of Search ..... 417/18, 32

[56] References Cited

U.S. PATENT DOCUMENTS 2,518,597 8/1950 Brooks ..... 417/32
2,811,019 10/1957 Courtney ..... 417/32
2,946,203 7/1960 Carver ..... 417/32 X
3,278,111 10/1966 Parker ..... 417/32
3,874,187 4/1975 Anderson ..... 417/32 X
4,820,130 4/1989 Eber et al. ..... 417/32

*Primary Examiner*—Leonard E. Smith

[57] ABSTRACT

The motor protector for a motor is located so as to be responsive to the discharge temperature of a compressor. The protector is thereby responsive to motor current and compressor discharge temperature. Additionally, by conduction, the protector is responsive to the motor temperature. For scroll compressors, specifically, this provides protection from excess heating of the scroll wraps without requiring an additional sensor.

3 Claims, 2 Drawing Sheets

SCROLL COMPRESSOR PROTECTOR

BACKGROUND OF THE INVENTION

In hermetic compressors used in refrigeration and air conditioning applications, the motors of the compressors are provided with overload protection. Typically, the motor protection is in the form of a bimetal switch or contact that opens an electrical circuit responsive to motor current and/or motor winding temperature. Except for isothermal processes, gases undergoing compression are heated. In scroll compressors specifically, the compression process produces a thermal gradient which results in a differential thermal expansion of the scroll wraps. Various schemes have been employed to overcome the effects of the differential expansion, particularly the axial expansion of the wrap, as evidenced by U.S. Pat. Nos. 4,457,674 and 4,472,120. Thus, when a scroll compressor is operating at design conditions, there will be contact/sealing between the tips of the scroll wraps and their facing plates for most, if not all, of the wrap length. Any non-contacting areas would be in the outer/low pressure region of the wraps where leakage would not be a significant problem. If, however, there should be a further heating of the scroll wraps beyond the design operating temperature such as the result of a blocked fan or fan failure, thermal expansion will be greatest and produce the highest loads on the inner wraps. This can result in localized failure of the wrap(s) and galling before the motor gets hot enough to trip the thermal protector. Even if this may result in severe localized wear resulting in leakage and poor performance at design operating conditions.

SUMMARY OF THE INVENTION

The protector for the motor of a hermetic scroll compressor is located at or near the discharge port of the scroll elements. The thermal protector is then responsive to motor overcurrent in the conventional manner, is responsive to motor overheating through conduction via the motor leads, and is, additionally, responsive to compressor discharge temperature. Because the protector is placed directly in the discharge gas stream immediately adjacent to the discharge port of the scroll elements, it can react more quickly then it could if attached in the conventional manner directly to the motor windings and far from the discharge gas stream.

It is an object of this invention to improve reliability of scroll compressors.

It is another object of this invention to eliminate the need for an additional sensing means to protect the scroll elements from overheating. These objects, and others as will become apparent hereinafter, are accomplished by the present invention.

Basically a line break protector is placed in the discharge gas stream close to the discharge port in a scroll compressor rather than being directly attached to the motor windings. The protector senses both the motor current and motor temperature (via conduction) as is conventional and, additionally, senses the discharge gas temperature near the discharge port with rise rates similar to those obtained in the scroll vanes, thereby eliminating the use of additional sensors to properly protect a scroll compressor from overtemperature.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
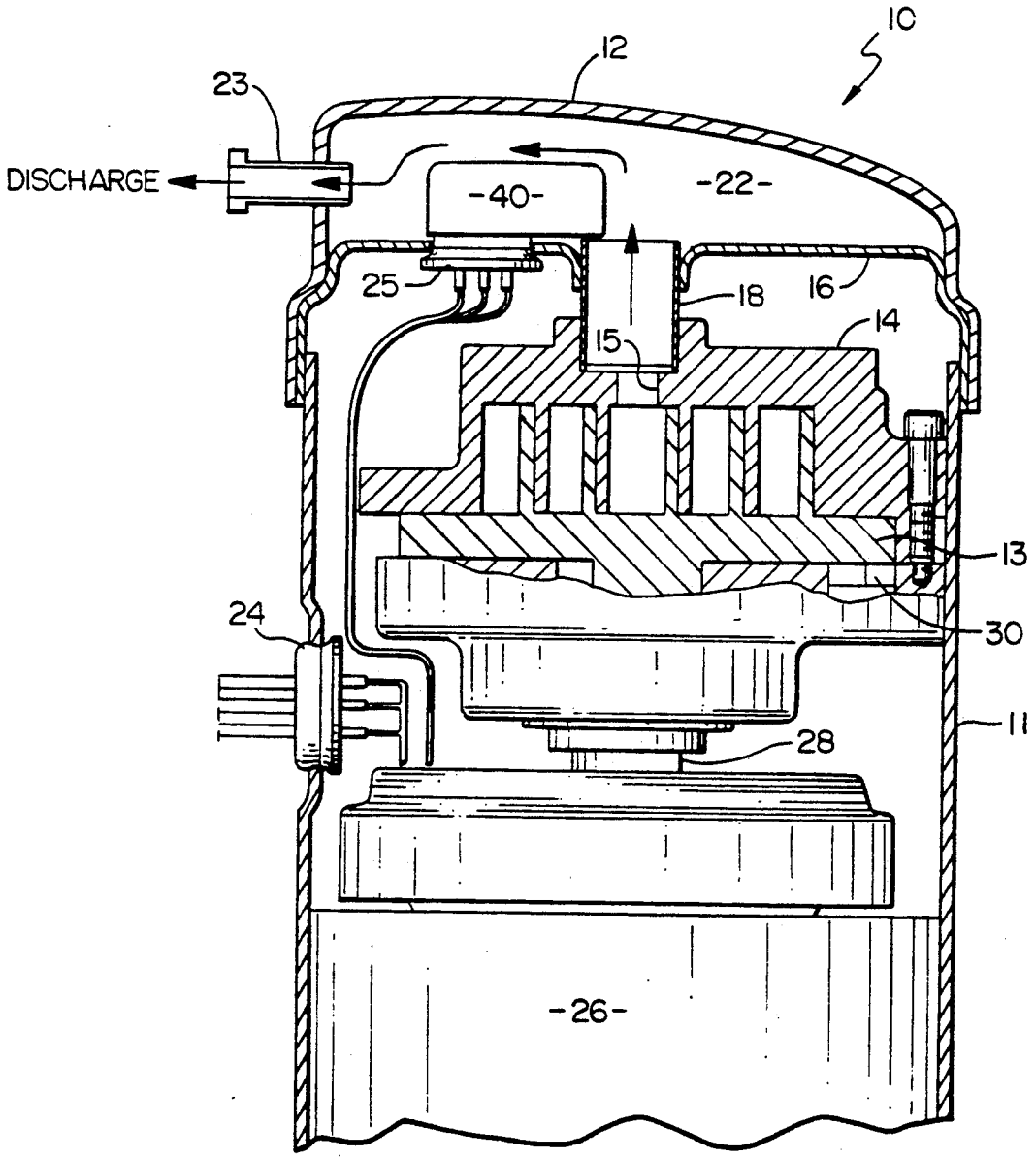
FIG. 1 is a partial sectional view of a low side hermetic scroll compressor employing the present invention.
Figure 2:
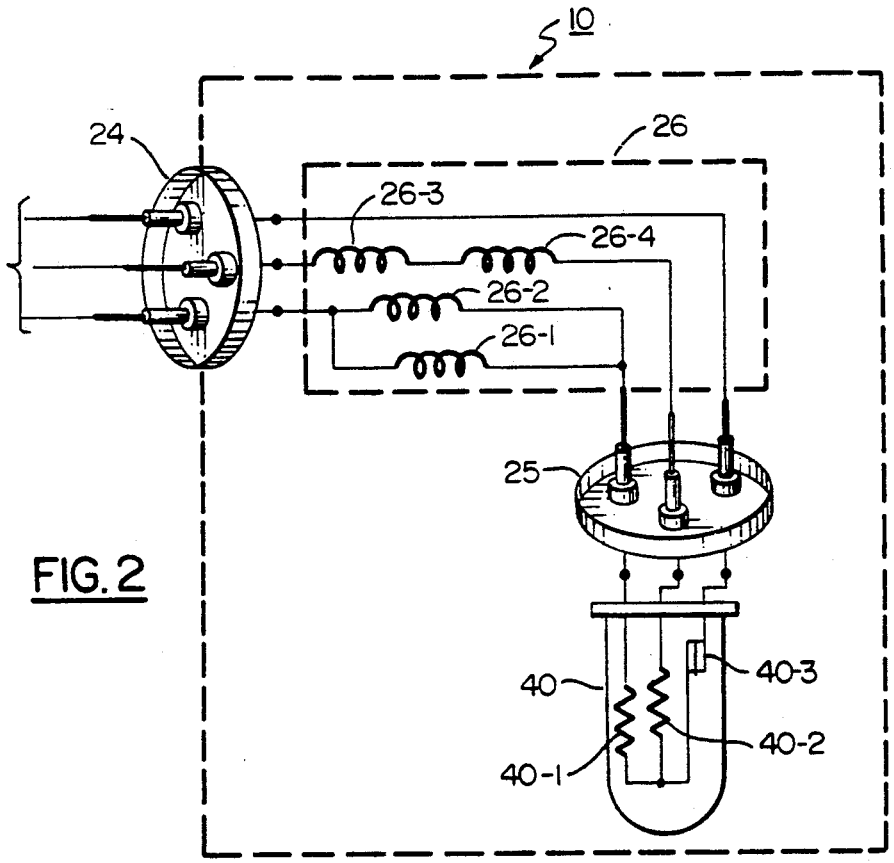
FIG. 2 is a schematic diagram for a single phase compressor.

In FIGS. 1 and 2, the numeral 10 generally designates a low side hermetic scroll compressor. A low side compressor is one in which all or most of the interior of the shell 11 is at suction pressure. A top cap 12 is secured to shell 11 in a fluid tight relationship. Separator plate 16 is secured to shell 11 and discharge tube 18 so as to coact with top cap 12 to define discharge chamber 22 and to separate discharge chamber 22, which is at discharge pressure, from the rest of the interior of shell 11, which is at suction pressure, during operation. Discharge tube 18 is also connected to outlet 15 in fixed scroll 14.

As is conventional, electric power is supplied to compressor 10 through shell 11 via hermetic terminal 24 which is wired to motor 26. Normally, protector 40 is located on the windings of motor 26 so as to be responsive to the temperature of the motor as well as the current. However, according to the teachings of the present invention, protector 40 is relocated from the motor windings to discharge chamber 22. This requires a second hermetic terminal 25 to be located in separator plate 16. Protector 40 is located in discharge chamber 22 near the outlet of discharge tube 18. As a result, gas passing into discharge chamber 22 passes over protector 40 whereby protector 40 will be maintained at a temperature close to that of the gas passing from outlet 15 and the temperature of orbiting scroll 13 and fixed scroll 14.

In operation, motor 26 drives orbiting scroll 13 through crankshaft 28 and orbiting scroll 13 is held to an orbiting motion by Oldham coupling 30. Orbiting scroll 13 coacts with fixed scroll 14 to compress the gas and in compressing the gas the gas is heated. The hottest gas is at the center of the fixed and orbiting scrolls and the greatest thermal expansion takes place there. As noted above, at design operating conditions the wraps of each scroll are in engagement with the plate portion of the facing scroll. Thus, any further temperature rise across the scrolls will reduce the area of contact by the wrap tips localizing the wear and stress at the innermost portions of the wrap which are already exposed to the highest pressures. The gas acted on by the scrolls 13 and 14 serially passes through outlet 15 and discharge tube 18 into discharge chamber 22 and in so doing passes over protector 40 which is thereby subjected to the highest temperatures encountered by scrolls 13 and 14. The hot, high pressure gas delivered to discharge chamber 22 is supplied to the refrigeration system (not illustrated) via discharge line 23.

Referring now to FIG. 2, it will be noted that for a single phase wiring configuration, motor 26 has two main windings 26-1 and 26-2 which are located in parallel with each other and in series, via terminal 25, with main winding heater 40-1 which is located in protector 40. Motor 26 also has start windings 26-3 and 26-4 in series, via terminal 25, with start winding heater 40-2 which is located in protector 40. Bimetal switch 40-3 is located in protector 40 in proximity to heaters 40-1 and 40-2 and is connected directly to the common lead. Thus, overcurrent to windings 26-1, 26-2, 26-3 and/or 26-4 will cause heaters 40-1 and/or 40-2 to heat bimetal switch 40-3 sufficiently to cause it to open thereby breaking the electrical circuit and thereby stopping motor 26 and compressor 10. Because protector 40 is in heat transfer relationship with the gas passing from discharge tube 18, bimetal switch 40-3 is also responsive to the temperature of the discharge gas, which reflects the highest temperature of the scrolls, and will open responsive to an excessive discharge temperature. Protector 40 would also be responsive to the temperature of windings 26-1 and 26-2 through conduction via the leads to hermetic terminal 25 and due to the heating of suction gas which cools the motor windings 26-1 and 26-2 and also contacts separator plate 16.

Figure 3:
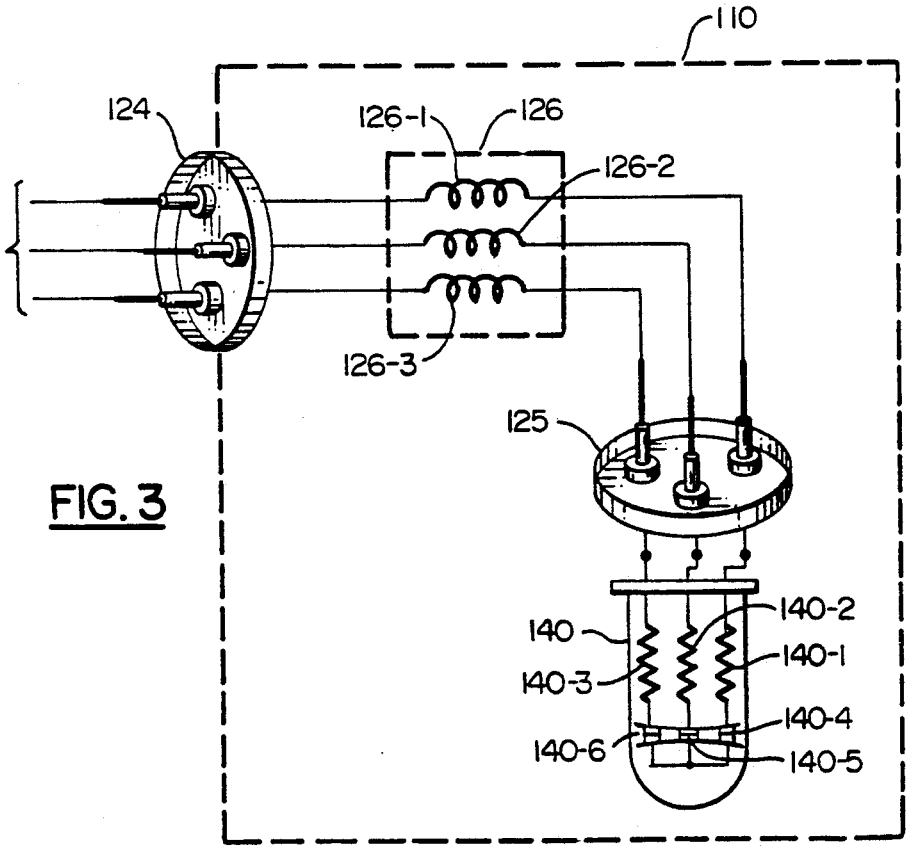
FIG. 3 is a schematic diagram for a three phase compressor.

In FIG. 3, the parts have been labeled 100 higher than similar structure in FIG. 2. The low side hermetic scroll compressor 110 has a motor 126 which is in a three phase configuration as is protector 140 and they are connected via terminal 125. Main windings 126-1, 126-2 and 126-3 are respectively located in the three power lines. Protector 140 includes main winding heaters 140-1, 140-2 and 140-3 and associated ganged bimetalic switches 140-4, 140-5 and 140-6, respectively. As in the case of the FIG. 2 embodiment, overcurrent in one or more of the windings 126-1, 126-2 and/or 126-3 will cause the corresponding heater 140-1, 140-2 and/or 140-3 to heat and thereby open all of the ganged bimetal switches 140-4, 140-5 and 140-6 breaking the circuit and stopping motor 126. As in the case of protector 40, the protector 140 is located so as to be responsive to the temperature of the gas passing through discharge tube 18 as well as being responsive to the temperature of windings 126-1, 126-2, and 126-3 via thermal conduction.

Although preferred embodiments of the present invention have been illustrated and described, other changes will occur to those skilled in the art. It is therefore intended that the scope of the present invention is to be limited only by the scope of the appended claims.

What is claimed is:

1. A low side hermetic compressor means comprising:

shell means;

separating means coacting with said shell means to divide said shell means into a first and a second portion;

said first portion containing running gear means and motor means for driving said running gear means whereby refrigerant gas is heated and pressurized and passes from said running gear means into said second portion via a discharge path;

means for supplying electrical power through said shell means to said motor means;

thermally responsive protector means responsive to an overcurrent in said motor means and located in said second portion in proximity with said discharge path and electrically connected to said motor means whereby said protector means is responsive to an overcurrent in said motor means as well as an overtemperature in said discharge path to cause said motor means to be disabled.

2. The compressor means of claim 1 wherein said compressor means is a scroll compressor.

3. The compressor means of claim 1 further including means for conducting heat from said motor means to said protector means whereby said protector means is additionally responsive to an overheating of said motor means.

* * * * *